US006841946B2

(12) United States Patent
Suzuki et al.

(10) Patent No.: US 6,841,946 B2
(45) Date of Patent: Jan. 11, 2005

(54) DISPLAY APPARATUS AND DRIVING METHOD OF THE SAME

(75) Inventors: Mutsumi Suzuki, Kodaira (JP); Masakazu Sagawa, Inagi (JP); Toshiaki Kusunoki, Tokorozawa (JP)

(73) Assignee: Hitachi, Ltd., Tokyo (JP)

( * ) Notice: Subject to any disclaimer, the term of this patent is extended or adjusted under 35 U.S.C. 154(b) by 49 days.

(21) Appl. No.: 10/327,915

(22) Filed: Dec. 26, 2002

(65) Prior Publication Data

US 2003/0160581 A1 Aug. 28, 2003

(30) Foreign Application Priority Data

Feb. 27, 2002 (JP) ..... 2002-050674
Aug. 27, 2002 (JP) ..... 2002-246097

(51) Int. Cl.[7] ..... G09G 3/10

(52) U.S. Cl. ..... 315/169.1; 315/169.2; 345/98; 345/204; 313/500

(58) Field of Search ..... 315/169.1, 169.2, 315/169.3; 345/55, 84, 75.2, 98, 99, 204, 214; 313/498, 500, 310

(56) References Cited

U.S. PATENT DOCUMENTS

| | | | | |
|---|---|---|---|---|
| 4,499,501 A | * | 2/1985 | Eriksen et al. | 358/302 |
| 5,872,424 A | | 2/1999 | Spindt et al. | 313/495 |
| 5,898,266 A | | 4/1999 | Spindt et al. | 313/495 |
| 6,072,457 A | * | 6/2000 | Hashimoto et al. | 345/100 |
| 6,278,233 B1 | * | 8/2001 | Sanou et al. | 313/495 |
| 6,538,391 B1 | * | 3/2003 | Suzuki et al. | 315/169.3 |
| 6,608,620 B1 | * | 8/2003 | Suzuki et al. | 345/204 |

FOREIGN PATENT DOCUMENTS

| | | |
|---|---|---|
| JP | 10-198303 | 7/1998 |
| JP | 2002-515133 | 5/2002 |

OTHER PUBLICATIONS

E. Yamaguchi et al, "A 10–in. Surface–Conduction Electron–Emitter Display", Journal of the SID 5/4, 1997, pp. 345–348.

T. Komoda et al, "Fabrication of Ballistic Electron Surface–Emitting Display on Glass Substrate", 2001 SID International Symposium Digest of Technical Papers, 2001, pp. 188–191.

* cited by examiner

*Primary Examiner*—Haissa Philogene
(74) *Attorney, Agent, or Firm*—Mattingly, Stanger & Malur, P.C.

(57) ABSTRACT

An object of the present invention is to obtain excellent images which are free from distortion in a flat display apparatus including electron-emitter elements, phosphors, and spacers. A structure of the present invention is such that the display apparatus comprises a display panel including a first substrate having a plurality of electron-emitter elements, a second substrate having phosphors, and spacers; and driving means employing a line-sequential scanning method; wherein scan pulse output is performed by the driving means, and the driving means performs scanning in such a manner that a scan is performed in the direction of approaching a relevant one of the spacers from far. Thus, the present invention realizes the excellent display images which are free from distortion by largely reducing or eliminating influence of charging of the spacers to be exerted on the images.

18 Claims, 19 Drawing Sheets

DISPLAY APPARATUS AND DRIVING METHOD OF THE SAME

FIELD OF THE INVENTION

The present invention relates to a display apparatus which displays images using electron-emitter elements placed in a matrix-form and phosphors and a driving method thereof.

RELATED ART

A field emission display (hereinafter referred to as "FED") has pixels each of which is disposed at an intersection of electrodes which are perpendicular to each other, the pixels respectively being provided with electron-emitter elements. An amount of emitted electrons is adjusted by adjusting voltages applied to the electron-emitter elements. The emitted electrons are accelerated under vacuum to be bombarded onto the phosphors, so that the bombarded phosphors emit light. Examples of the electron-emitter elements are a field-emission type cathode, MIM (Metal-Insulator-Metal) cathode, a carbon-nanotube cathode, a diamond cathode, a surface-conduction electron-emitter element, and so forth. Thus, in the present specification, the term "field emission display (FED)" is used in a wider sense. As used herein, the term is not limited to those using the field-emission type cathode, but used as a general term for cathodoluminescent flat-panel displays wherein the electron-emitter elements and phosphors are used in combination.

An FED Shown in FIG. 2 has a cathode plate 601 on which electron-emitter elements are placed and a phosphor plate 602 on which phosphors are placed, the cathode plate 601 and the phosphor plate 602 facing to each other. A space between the cathode plate 601 and the phosphor plate 602 is maintained under vacuum in order that electrons emitted from the electron-emitter elements 301 reach the phosphor plate 602 to excite the phosphors to emit light. Therefore, spacers (columns) 60 are disposed between the cathode plate 601 and the phosphor plate 602 to endure an external atmospheric pressure.

The phosphor plate 602 has an acceleration electrode 122, and a high voltage of about 1 to 8 KV is applied to the acceleration electrode 122. The electrons emitted from the electron-emitter elements 301 are accelerated by the high voltage so that the electrons are bombarded onto the phosphors to excite the phosphors to emit light. Since the high voltage is applied between the cathode plate 601 and the phosphor plate 602, each of the spacers 60 which are in contact with the cathode plate 601 and the phosphor plate 602 is formed from an insulator or a high-resistance material.

A portion of the electrons emitted from the electron-emitter elements 301 in the vicinity of the spacer 60 sometimes hits the spacer 60. Since the insulator or the high resistance material is used for forming the spacer 60, the spacer 60 becomes charged by the electron bombardment. If the spacer 60 is charged, an electric field in the vicinity of the spacer 60 is changed to affect on trajectories of the electrons emitted from the electron-emitter elements, thereby preventing the electrons from being bombarded onto a desired position of the phosphor plate 601. This causes problems such as image distortion, color distortion and so forth.

As a result of prior art searches based on the present invention and from the standpoint of a driving method for reducing the influence on the image distortion which is caused by the charging of spacer, Published PCT Application, whose publication number is 2002-515133 and Japanese Patent Laid-open No. 10-198303 were found.

The former invention is totally different from the present invention as it is based on the premise that the areas adjacent to the spacer are less subject to the influence of the charging. While, in the latter invention, an image area is divided into large regions so as to place spacers equally, and a display apparatus is driven with the large regions being skipped in such a manner that pixels in each of the large regions do not emit light successively.

The present invention provides means for preventing the adverse effects such as the image distortion due to the charging of spacer, which would be otherwise exerted on images to be displayed.

A method of discharging the electric charges by coating an appropriate coating material on the spacer surface is disclosed in U.S. Pat. No. 5,872,424 (by Spindt et al., "High Voltage Compatible Spacer Coating") in order to mitigate the charging problem. Hereinafter, the influence exerted on the charging state of the spacer, which is caused by the electron bombardment onto the spacer, will be described.

FIG. 3 is a sectional view of a spacer. It is assumed that currents flow uniformly on a side face of the spacer. An effective current density on the spacer is indicated by jc.

In general, secondary electrons are emitted by an electron bombardment onto a solid material. A proportion of the secondary electrons to the bombarding electrons (primary electrons) will hereinafter be referred to as "secondary electron emission coefficient δ". The solid material which has been bombarded with the electrons becomes positively charged if δ>1, while it is negatively charged if δ<1. If δ=1, no charging occurs since the primary electrons and the secondary electrons cancel each other. When the currents actually flown to the spacer is indicated by j0, the effective current density jc which contributes to the charging of spacer is expressed by the following equation:

$$jc=\int j_0(E)[1-\delta(E)]dE \tag{1}$$

Since the secondary electron emission coefficient δ depends on the energy of the primary electrons, it is expressed by using the integral.

If no charging occurs, a potential of the spacer surface is expressed by the following equation:

$$V0(z)=V_{HV}*(z/L) \tag{2}$$

where, $V_{HV}$ represents an applied voltage to the acceleration electrode 122, L represents a height of the spacer, and z represents a position in the height direction. A common electrode 420 near the cathode plate 602 is set to a ground potential.

If the charging occurs due to the electron bombardment, a term ΔVw(z) caused by the charging is superimposed:

$$V(z)=V0(z)+\Delta Vw(z) \tag{3}$$

Sheet resistance of the spacer surface is represented by $\rho_{sw}$. The bombarded electrons flow via the resistance to the acceleration electrode 112 of the phosphor plate 602 side and the common electrode 420 of the cathode plate 601 side. Therefore, the center portion in the distribution of ΔVw(z) is dense as shown in FIG. 3. Here, the maximum value ΔVw is expressed by the following equation:

$$\Delta Vw=(\rho_{sw}L^2/8)jc \tag{4}$$

The derivation of equation (4) is disclosed in U.S. Pat. No. 5,872,424 (Spindt et al., "High Voltage Compatible Spacer Coating"), for example.

If a horizontal electric field caused by the additional term $\Delta Vw(z)$ due to the spacer charging is too large to be ignored in view of a vertical electric field which should be primarily formed between the phosphor plate 602 and the cathode plate 601, distortion occurs in the trajectory of an electron beam emitted from the electron-emitter element, to thereby influence on images. More specifically, $\Delta Vw$ must be maintained satisfactorily small in order to obtain excellent images.

Accordingly, the sheet resistance $\rho_{sw}$ of the spacer must be satisfactorily small. In order to make $\rho_{sw}$ smaller, a conductive material may be used for forming the spacer or a conductive coating film may be deposited on the spacer. Further, it is also effective to use a material having the secondary electron emission coefficient $\delta$ of about 1 as the coating material. As is apparent from equation (1), if $\delta$ is 0.9, for example, the effective current density jc becomes 0.1×j0 even when the currents flowing to the spacer are identical to one another. These methods are disclosed in, for example, U.S. Pat. No. 5,872,424.

However, in some cases, the image distortion could not perfectly eliminated even if $\Delta Vw$ expressed by equation (4) is made smaller. Further, it is desirable that $\rho_{sw}$ be as large as possible in order to minimize an amount of leakage currents and, therefore, there has been a demand for a method for eliminating the image distortion with the largest $\rho_{sw}$ as possible.

SUMMARY OF THE INVENTION

A brief summary of the invention disclosed in the present application is as described below.

According to an aspect of the present invention, a display apparatus comprises: a display panel, the display panel including a first substrate having a plurality of electron-emitter elements, a second substrate having phosphors, and spacers; and driving means employing a line-sequential scanning method; wherein scan pulse output is performed by the driving means, and the driving means performs scanning in the vicinity of the spacers in such a manner that a scan is performed in the order of approaching a relevant one of the spacers from far.

According to another aspect of the present invention, a display apparatus comprises: a display panel, the display panel including a first substrate having a plurality of electron-emitter elements, a second substrate having phosphors, and spacers; and driving means employing a line-sequential scanning method; wherein scan pulse output is performed by the driving means, and the driving means performs scanning in such a manner that scan lines other than those adjacent to and second adjacent to a relevant one of the spacers are scanned during a period from after an application of a scan pulse to the adjacent scan line to an application of a scan pulse to the second adjacent scan line.

According to a further aspect of the present invention, a display apparatus comprises: a display panel, the display panel including a first substrate having a plurality of electron-emitter elements, a second substrate having phosphors, and spacers; and driving means employing a line-sequential scanning method; wherein the display panel further includes scan lines; the scan lines includes an adjacent scan line which is adjacent to a relevant one of the spacers and a nearby scan-lines region consisting of scan lines which include a scan line adjacent to the adjacent scan line; scan pulse output is performed by the driving means; and the driving means applies a scan pulse to the adjacent scan line after applying scan pulses to the scan lines in the nearby scan-lines region.

The driving means has multi-line memory means for storing image signals for a plurality of lines.

The multi-line memory means has a memory capacity for scan lines of not more than 1/10 of actual scan lines.

In the display apparatus, interlace scanning is performed.

According to a still further aspect of the present invention, a display apparatus comprises: a display panel, the display panel including a first substrate having a plurality of electron-emitter elements, a second substrate having phosphors, and spacers; and driving means employing a line-sequential scanning method; wherein scan pulse output is performed by the driving means, and scanning is suspended during a period from after an application of a scan pulse to a scan line which is adjacent to a relevant one of the spacers to an application of a scan pulse to a scan line which is second adjacent to the spacer.

According to a still another aspect of the present invention, there is provided a drive method of a display apparatus which comprises a display panel, the display panel including a first substrate having a plurality of electron-emitter elements, a second substrate having phosphors, and spacers; and driving means employing a line-sequential scanning method; wherein scanning in the vicinity of the spacers is performed in such a manner that the driving means scans in the order of approaching a relevant one of the spacers from far.

In a known FED, images are typically displayed by the line-sequential scanning method. More specifically, pixels on one scan line are lit at some instant, and then pixels on an adjacent scan line are lit successively. When the whole display screen is scanned by repeating the above operation, an image is recognized by a viewer owing to the persistence of the human vision.

There has been proposed the two-line-at-a-time drive method wherein two lines are scanned simultaneously. The method enables to increase a duty ratio of the light emission and to achieve the effect of displaying images with high brightness by driving two lines simultaneously. Further, in the case of the interlace scan method, the scanning is performed by skipping every other lines in place of scanning adjacent lines sequentially.

In the present invention, the driving method as referred to as "line-sequential scanning method" includes the two-line-at-a-time drive method, the interlace drive method, and so forth. More specifically, the principle of the driving method as referred to as "line-sequential scanning method" in the present invention is that pixels on one or a few scan line(s) are lit at a certain instance.

The following relationship is established when N0 represents the number of scan lines in a display apparatus; n1 represents the number of scan lines which are lit at some instance; B0 represents a brightness of the whole display screen; and b1 represents a peak luminance when a certain scan line is lit:

$$B0=b1\times(n1/N0) \tag{5}$$

The current bombarded onto a phosphor and luminance of the phosphor are substantially proportional to each other. Accordingly, in the case of FED, the following equation holds:

$$I0=i1\times(n1/N0) \tag{6}$$

where, I0 represents a time-averaged value of the currents emitted from the current-emitter elements, and i1 represents a peak value of the emission currents. If the number of scan lines N0 is 1,000 and the number of scan lines lit at some instance n1 is 1, i1/IO=1,000 holds. That is, the peak value of emission currents is much larger than the time-averaged value of emission currents.

Equation (4) is derived based on the assumption that an equilibrium state is established between the currents bombarded onto the spacer and the currents flowing on the spacer. More specifically, jc of equation (4) corresponds to I0 of equitation (6).

FIG. 4 is a plan view showing a spacer and scan lines in the vicinity of the spacer. It is assumed that a scan line adjacent to the spacer is scanned at the time t(n) time and a scan line adjacent to the scan line adjacent to the spacer is scanned at the time t(n+1).

Since the n-th scan line is adjacent to the spacer, the current which is bombarded onto the spacer when electrons are emitted from the electron-emitter element on the n-th scan line becomes the largest. Further, the peak value of the emission currents is (N0/n1) times the time-averaged value. The spacer is charged due to the largest current bombardment, to thereby generate a superimposed voltage ΔVw, peak. The charging currents flow to the phosphor plate or the cathode plate via resistance of the spacer to be reduced, and ΔVw, peak is decayed at a certain time constant with the reduction. The decay is schematically shown in FIG. 5. Since the scan line (n+1) is scanned immediately after the n-th scan line, electrons are emitted in a state where the influence caused by ΔVw, peak remains. Thus, an electron trajectory of the scan line (n+1) is influenced by the charging of the spacer. Although ΔVw, peak is reduced gradually on the scan line (n+2), there is the possibility that ΔVw, peak influences on the scan line.

As described above, the effects provided by the peak value of emission currents and the time constant of spacer charging must be taken into consideration.

Shown in FIG. 1 is an example of a scanning method according to the present invention. FIG. 1 corresponds to the conventional scanning method of FIG. 4.

The scan line (n−2) is scanned at the time t(n−2). Then the scan line (n−1) is scanned at the time t(n−1). That is, the scan is performed in the order of approaching the spacer 60 from far.

At the subsequent time t(n), the scan line (n+3), which is the fourth scan line from the spacer 60 is scanned. The scan line (n+2) is scanned at the subsequent time t(n+1). The scan line (n+1) is scanned at the subsequent time t(n+2), and then the scan line (n), which is adjacent to the spacer 60, is scanned at the subsequent time t(n+3). Thus, the scan is performed in the order of approaching the spacer 60.

After that, the scan line (n+4), which is the fifth scan line from the spacer 60, is scanned at the time t(n+4), and the scan line (n+5) is scanned at the subsequent time t(n+5).

According to the present invention, the scan lines in the vicinity of the spacer are scanned in the scan order of approaching the spacer as described above. Thus, the scan line which is satisfactorily remote from the spacer is scanned immediately after the scanning of the scan line adjacent to the spacer, i.e., at the time when the spacer has the largest bombarded currents. Therefore, the influence, which is caused by the spacer charging, is hardly exerted on the electron beam trajectory.

As described above, the present invention enables to minimize the image distortion due to the spacer charging.

DETAILED DESCRIPTION OF THE PREFERRED EMBODIMENTS

Hereinafter, a display apparatus according to the present invention will be described in more details with reference to preferred embodiments of the present invention shown in the accompanying drawings.

Embodiment 1

A first embodiment according to the present invention is as described below.

In the present embodiment, thin-film electron emitters, more specifically, MIM (Metal-Insulator-Metal) electron emitters, are used as electron-emitter elements 301.

Figure 6:
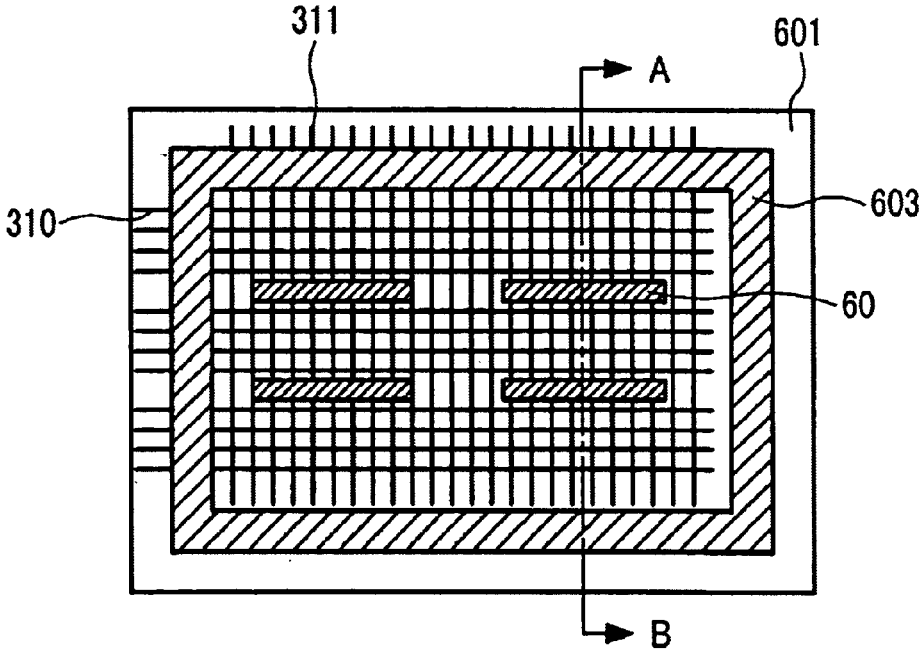
FIG. 6 is a plan view showing a configuration of a display panel of a display apparatus of a first embodiment according to the present invention.
Figure 7:
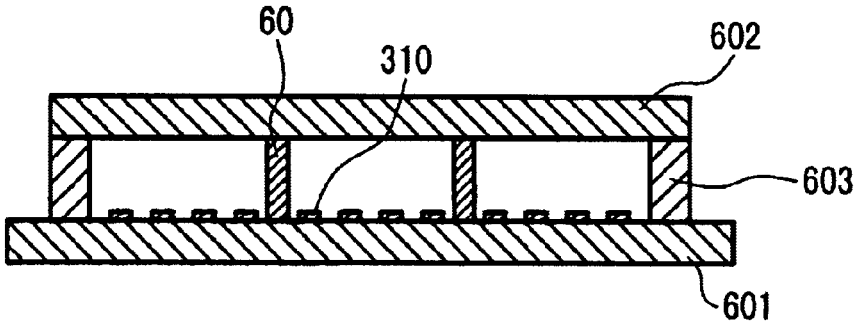
FIG. 7 is a sectional view showing the configuration of the display panel of the display apparatus of the first embodiment according to the present invention.

FIG. 6 is a plan view showing a display panel used in the present embodiment. FIG. 7 is a sectional view taken along the line A-B of FIG. 6.

A vacuum region is defined by a cathode plate 601, a phosphor plate 602, and a frame component 603. The vacuum region is provided with spacers 60 for enduring the atmospheric pressure. The form, number, and arrangement of the spacers 60 are not crucial. Scan electrodes 310 are disposed in the horizontal direction on the cathode plate 601, and data electrodes 311 are disposed perpendicular to the scan electrodes. Intersections of the scan electrodes 310 and the data electrodes 311 serve as pixels. Here, it should be understood that the pixels correspond to subpixels in a color display apparatus.

Although only 12 scan electrodes 310 are shown in FIG. 6, an actual display has a several hundreds to a several thousands of scan electrodes. The same applies to the data electrodes 311.

The electron-emitter elements 301 are respectively placed at the intersections of the scan electrodes 310 and the data electrodes 311.

Figure 8:
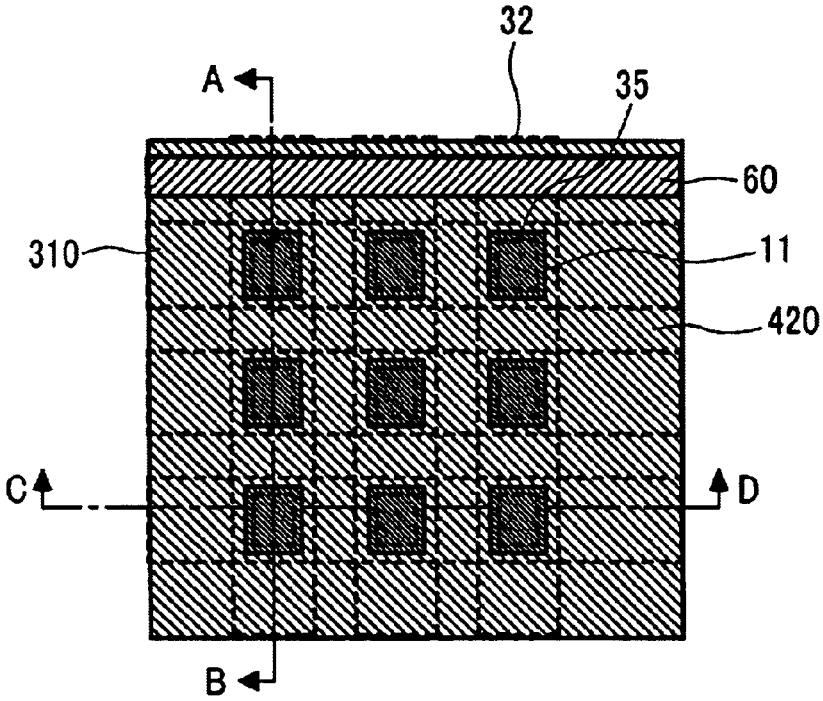
FIG. 8 is a plan view showing a part of a cathode plate of the display apparatus of the first embodiment according to the present invention.

FIG. 8 is a plan view showing a part of the cathode plate 601 of FIG. 6. A portion other than those of electron-emission regions 35 and top electrodes 11 is covered with a common electrode 420. A bottom face of each of the spacers 60 is in contact with the common electrode 420. Since the scan electrodes 310 and top electrode buslines 32 (also used as the data electrodes 311 in the present embodiment) cannot be seen as being covered with the common electrode 420, they are indicated by dotted lines.

The thin-film electron emitters are used as the electron-emitter elements 301 in the present embodiment. The electron emission regions (regions enclosed with dotted line) 35 are respectively positioned on regions on which the scan lines intersect with the top electrode buslines 32, and electrons are emitted from the electron emission regions 35.

Figure 9A:
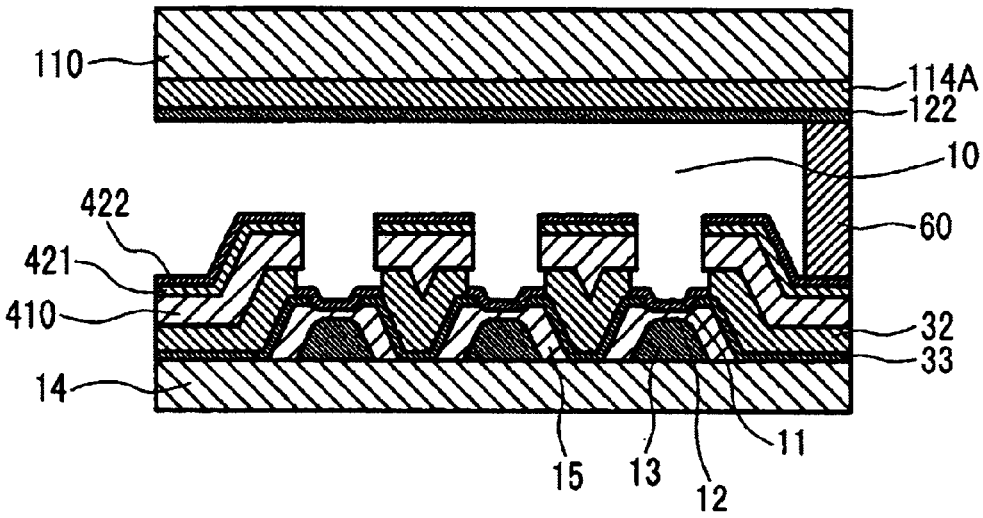
FIG. 9A is a sectional view showing a part of the cathode plate of the display apparatus of the first embodiment according to the present invention.
Figure 9B:
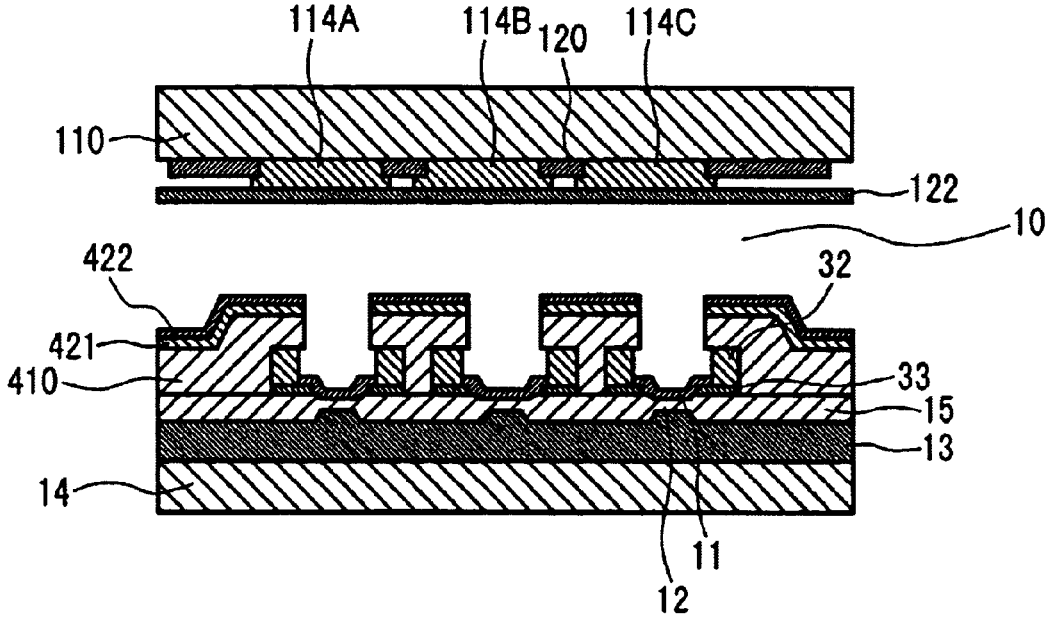
FIG. 9B is a sectional view showing a part of the cathode plate of the display apparatus of the first embodiment according to the present invention.

Each of FIGS. 9A and 9B shows a display panel which is used in the present invention; FIG. 9A is a sectional view taken along the line A-B of FIG. 8, and FIG. 9B is a sectional view taken along the line C-D of FIG. 8.

The configuration of the cathode plate 601 is as described below.

The thin-film electron emitters 301 (the electron-emitter elements 301 in the present embodiment), each of which is formed of a base electrode 13, an insulator 12, and the top electrode 11, are formed on an insulative substrate 14 made from glass or the like. Each of the top electrode buslines 32 is electrically connected with the top electrode 11 via a top electrode busline under-layer film 33 to serve as a current feeding line for the top electrode 11. Further, the top electrode buslines 32 serve as the data electrodes 311 in the present embodiment.

A region (hereinafter referred to as "cathode region 601") of the cathode plate 601 on which the electron-emitter elements 301 are placed in a matrix-form is covered with an interlayer insulating film 410, and the common electrode 420 is formed on the cathode region 610. The common electrode 420 is formed of a stacked film consisting of common electrode films A 421 and B 422.

The common electrode 420 is connected to a ground potential. The spacers 60 are in contact with the common electrode 420, and the common electrode 420 serves to flow the currents flowing from acceleration electrodes 122 via the spacers 60 and to flow an electric charge electrified on the spacers 60.

In FIGS. 9A and 9B, the scale reduction in the height direction is an optional one. More specifically, each of thicknesses of the base electrode 13 and the top electrode busline 32 is not more than a several micrometers, and the distance between the substrate 14 and the front plate 110 is about 1 to 3 mm.

A fabrication method of the cathode plate 601 will be described with reference FIGS. 10A to 10I. FIGS. 10A to 10I generically shows a process of fabricating the thin-film electron emitters on the substrate 14. The electron-emitter element to be formed on the intersection of one of the scan electrodes 310 and one of the data electrodes 311, which are shown in FIGS. 8 and 9, is shown in FIGS. 10A to 10I. In each of FIGS. 10A to 10I, a plan view is shown on the right hand side and a sectional view taken along the line A-B is shown on the left hand side.

Figure 10A:
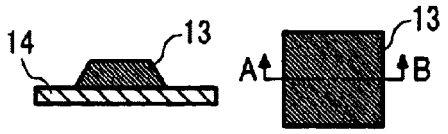
FIGS. 10A to 10I are diagrams generically showing a fabrication process of the cathode plate of the display apparatus of the first embodiment according to the present invention.

An Al alloy layer having a thickness of 300 nm, for example, is formed as a material for the base electrode 13 on the insulative substrate 14 made from glass or the like. In the present embodiment, an Al—Nd alloy is used. The Al alloy layer may be formed by the sputtering method or the resistive-heating evaporation method. Then, the Al alloy layer is processed to be in a stripe-form by a resist formation employing photolithography and etching, so that the base electrode 13 is formed. The resist is not crucial so far as it is suitable for the etching, and the etching may be the wet etching and/or the dry etching. This process step is shown in FIG. 10A.

Figure 10B:
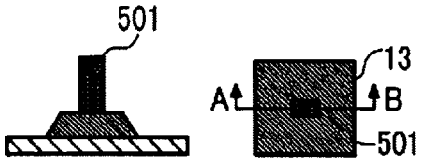
Figure 10C:
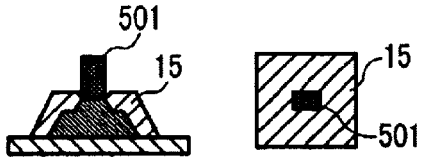

The resist is coated and then subjected to a UV-ray exposure to form a resist pattern 501 shown in FIG. 10B. A quinonediazide-based positive resist, for example, may be used as the resist. An anodization is performed with the resist pattern 501 being laid to form a protection layer 15. In the present embodiment, the anodization is performed at an anodization voltage of about 100 V to achieve a thickness of the protection layer 15 of about 140 nm. This process step is shown in FIG. 10C.

Figure 10D:
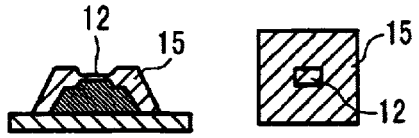

After removing the resist pattern 501, the base electrode 13 which has been covered with the resist are anodized to form the insulator 12. In the present embodiment, an anodiztaion voltage was set to 6V to achieve a thickness of the insulator 12 of 8 nm. This process step is shown in FIG. 10D.

A region on which the insulator 12 is formed serves as the electron-emission region 35. More specifically, the region enclosed by the protection layer 15 is the electron-emission region 35.

Figure 10E:
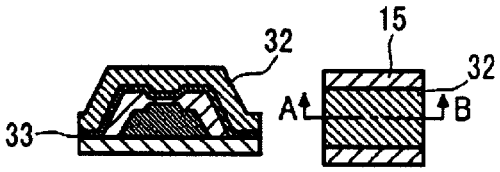

Then, after depositing the top electrode busline under-layer film 33 and the top electrode busline 32, the top electrode buslines 32 are formed by patterning. The top electrode buslines 32 serve also as the data electrodes 311. This process step is shown in FIG. 10E. In the present embodiment, a tungsten film having a thickness of about 10 nm is formed to serve as the top electrode busline under-layer film 33, and an Al alloy layer having a thickness of about 300 nm is formed to serve as the top electrode buslines 32. Gold or the like may also be used as the material for the buslines 32.

Figure 10F:
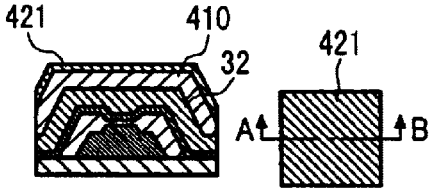
Figure 10G:
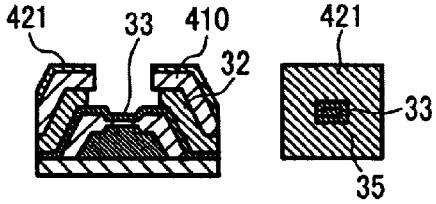

Then, the interlayer insulating film 410 and a common electrode film A 421 are deposited (see FIG. 10F). A material to be used for the interlayer insulating film 410 and a material to be used for the common electrode film A 421 may be those which can be subjected to the etching simultaneously. For example, if $Si_3N_4$ is used for the interlayer insulating film 410, tungsten, molybdenum or titanium may be used for the common electrode film A 421.

Then, openings are made by etching on the electron-emission region 35 and the interlayer insulating film around the electron-emission region 35. After that, openings are made by etching also on the top electrode buslines 32 (see FIG. 10G). The openings of the top electrode buslines 32 should be made larger than those of the interlayer insulating film 410 by properly setting the etching conditions. The thus-obtained overhang-like openings ensure separation between the electrodes of electron-emitter elements in the subsequent process step.

Figure 10H:
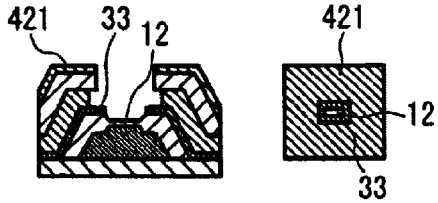
Figure 10I:
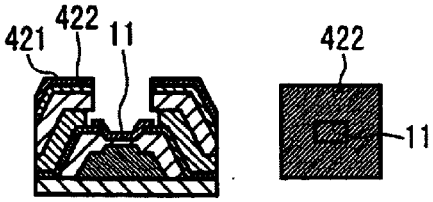

The top electrode busline under-layer film 33 is subjected to etching to have the insulator 12 exposed, thereby establishing the pattern shown in FIG. 10H. Lastly, the top electrode 11 is deposited by the sputtering method or the like. Among the top electrode materials, one which is deposited directly on the insulator 12 serves as the top electrode 11. In turn, the top electrode material which is deposited on the common electrode film A 421 serves as the common electrode film B 422. The common electrode film B422 serves as the common electrode 420.

A conductive film having a thickness of about 10 nm is used as the top electrode 11. A stacked film formed of an iridium (Ir) film, a platinum (Pt) film, and a gold (Au) film having a total thickness of 6 nm is deposited to be used as the top electrode 11.

Since the interlayer insulating film 410 has the overhang-like shape as described above, the top electrodes of the electron-emitter elements are electrically separated from the common electrode 420. Therefore, it is unnecessary to pattern the top electrodes by etching or the like. Thus, the present invention is free from surface contamination which would be otherwise caused by chemicals during the etching process, thereby eliminating probability of deterioration in electron emission characteristics of the electron-emitter elements 301.

The electrical connection between the top electrode 11 and the top electrode busline 32 is established via the top electrode busline under-layer film 33. Since the top electrode busline under-layer film 33 has a thickness of about 10 nm, which is quite thin, the electrical connection is established without fail even if the top electrode 11 is thin.

The cathode plate 601 having the configuration shown in FIG. 9 is obtained by the above-described process.

A configuration of the phosphor plate 602 is as described below.

A black matrix 120, red phosphors 114A, green phosphors 114B, and blue phosphors 114C are formed on the transparent front panel 110 which is made from glass or the like. An acceleration electrode 122 is also formed on the front panel 110. The acceleration electrode 122 is formed of an aluminum film having a thickness of about 70 to 100 nm. Electrons emitted from the thin-film electron emitters 301 are accelerated by an acceleration voltage applied to the acceleration electrode 122 to be made incident to the acceleration electrode 122 and then collide with the phosphors 114 after passing through the acceleration electrode, thereby allowing the phosphors 114 to emit light.

Details of a fabrication method of the phosphor plate 602 is disclosed, for example, in Japanese Patent Laid-open No. 2001-83907.

An appropriate number of spacers 60 are placed between the cathode plate 601 and the phosphor plate 602. As shown in FIG. 6, the cathode plate 601 and the phosphor plate 602 are sealed with a frame component 603 being inserted therebetween. Further, each of spaces 60 enclosed by the cathode plate 601, the phosphor plate 602, and the frame component 603 is evacuated to produce a vacuum.

Figure 11:
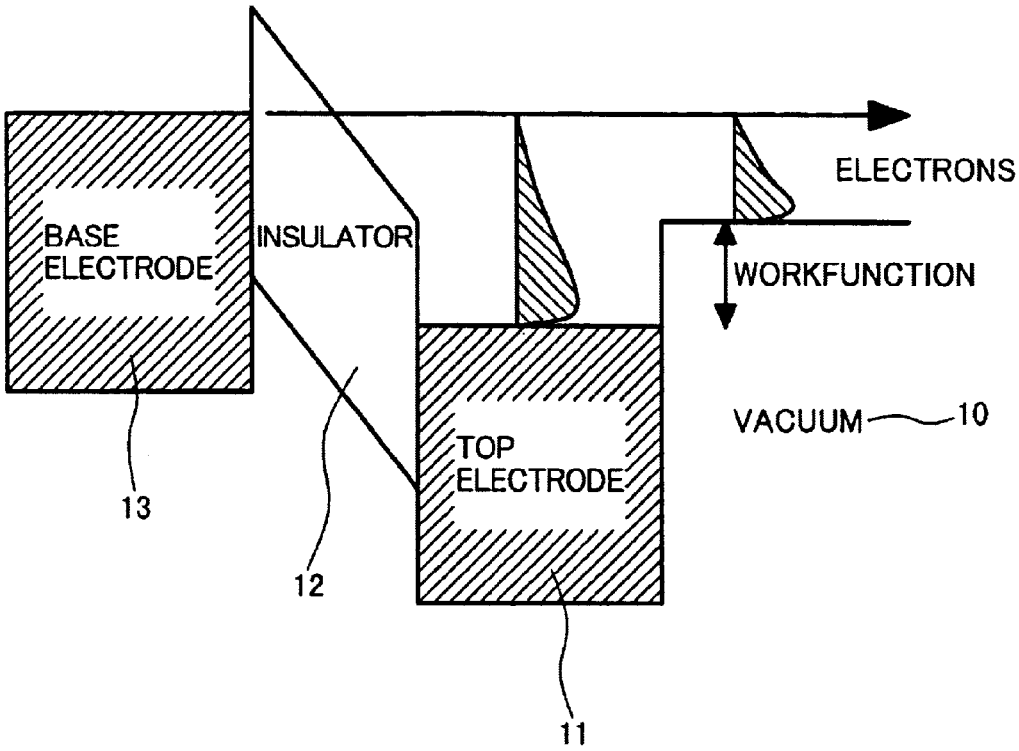
FIG. 11 is a diagram showing an electron emission mechanism of the display apparatus of the first embodiment according to the present invention.

Each of the thin-film electron emitters is formed of three layers of the base electrode 13, the insulator 12, and the top electrode 11. An electron emission mechanism of the thin-film electron emitter will be described with reference to FIG. 11. FIG. 11 is an energy band diagram showing an instance at which a voltage is applied between the top electrode and the base electrode of the thin-film electron emitter. A high electric field is applied to the insulator upon application of the voltage between the top electrode 11 and the base electrode 13, so that electrons pass through the insulator 12 owing to the tunneling phenomenon. The electrons are accelerated by the electric field to become hot electrons and then enter the top electrode 11. A portion of the hot electrons is scattered by scattering in the top electrode 11, and thereby kinetic energy thereof is reduced. Electrons having a kinetic energy larger than a workfunction of the top electrode 11 are emitted into a vacuum space 10.

Figure 12:
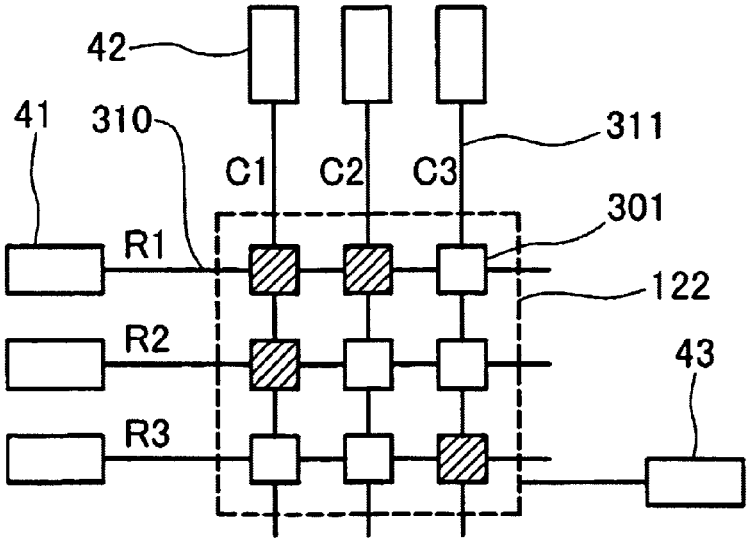
FIG. 12 is a diagram showing a connection to a drive circuit of the display apparatus of the first embodiment according to the present invention.

FIG. 12 is a connection diagram showing connections to drive circuits of the display panel 100 fabricated in the manner described above. The scan electrodes 310 are respectively connected to scan electrode drive circuits 41, and the data electrodes 311 are respectively connected to data electrode drive circuits 42. The acceleration electrode 122 is connected to an acceleration electrode drive circuit 43. A dot on an intersection of an n-th scan electrode 310Rn and an m-th data electrode 311Cm is represented by (n, m).

Figure 13:
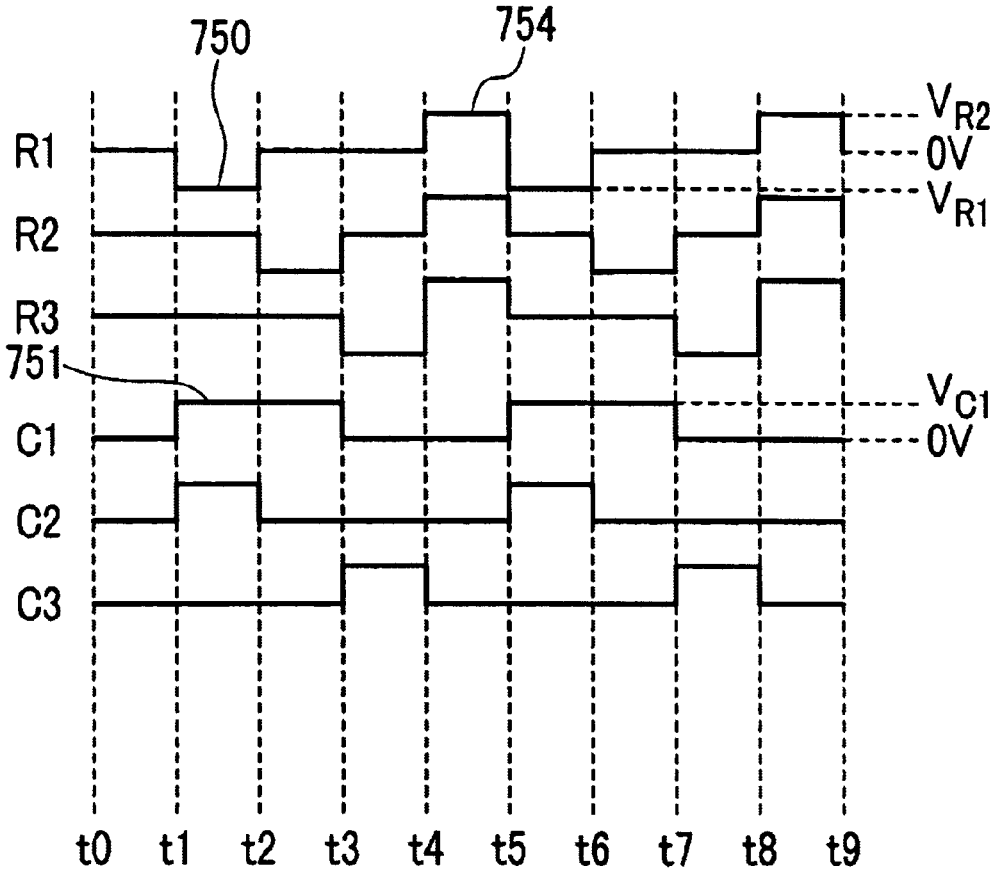
FIG. 13 is a diagram showing a driving method of the display apparatus of the first embodiment according to the present invention.

Output voltage waveforms of the drive circuits are shown in FIG. 13. Although not shown in FIG. 13, a voltage of about 3 to 6 KV is applied to the acceleration electrode 122 at all times.

At the time t0, electrons are not emitted because no voltage is applied to the electrodes, and none of the phosphors 114 emits light.

At the time t1, a scan pulse 750 of a voltage of VR1 is applied to a scan electrode 310R1, and a data pulse 751 having a voltage of +VC1 is applied to each of data electrodes 311C1 and 311C2. Since a voltage of (VC1−VR1) is applied between the base electrode 13 and the top electrode on each of dots (1, 1) and (1, 2), electrons are emitted from thin-film electron emitters on the two dots to the vacuum space 10 by setting the (VC1−VR1) to be not less than a threshold voltage for electron emission. In the present invention, VR1 is set to −5 V and VC1 is set to 4.5 V. The emitted electrons are accelerated by the voltage applied to the acceleration electrode 122 to collide with the phosphors 114, thereby allowing the phosphors 114 to emit light.

At the time t2, a dot (2, 1) is lit in the same manner by an application of a voltage of VC1 to the data electrode 311C1.

Dots with hatching shown in FIG. 12 are lit by the applications of the voltage waveforms shown in FIG. 13.

Thus, desired images or information can be displayed by changing signals to be applied to the data electrodes 311. It is possible to display images having grayscales by appropriately changing the magnitudes of the voltages VC1 to be applied the data electrodes 311 in accordance with image data.

As shown in FIG. 13, a voltage VR2 is applied to each of the scan electrodes 310 at the time t4. VR2 is 5 V in the present embodiment. Since a voltage applied to each of the data electrodes 311 is 0 V in this case, a voltage of −VR2, which is −5 V, is applied to each of the thin-film electron emitters 301. Thus, the lifetime property of the thin-film electron emitters is improved as a result of the application of a voltage (reverse pulse 754) having a polarity reverse to that at the time of electron emission. Further, if vertical blanking periods of image signals are used as periods for applying the reverse pulse (t4 to t5 and t8 to t9 in FIG. 13), the periods coordinate with the image signals.

An example of 3×3 dots is used in the foregoing description referring to FIGS. 12 and 13 for brevity; however, an actual display apparatus has a several hundreds to a several thousands of scan electrodes and a several hundreds to a several thousands of data electrodes. Shown in FIG. 1 are scan electrodes in the vicinity of a spacer 60.

Figure 1:
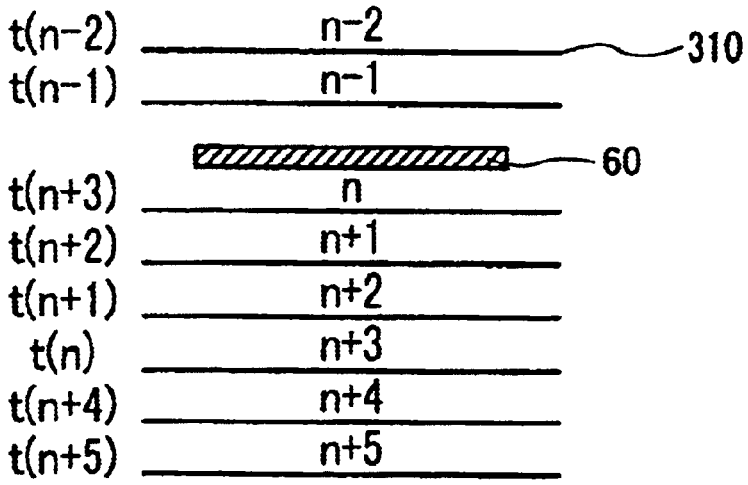
FIG. 1 is a diagram showing a driving method of a display apparatus according to the present invention.
Figure 2:
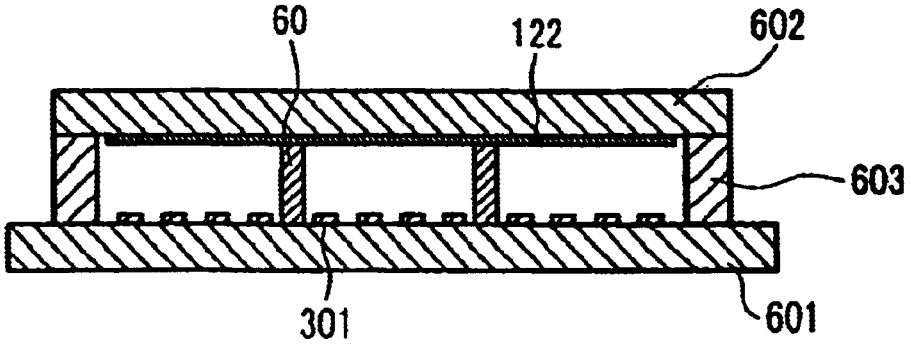
FIG.2 PRIOR ART
FIG. 2 is a sectional view schematically showing a field emission display.
Figure 3:
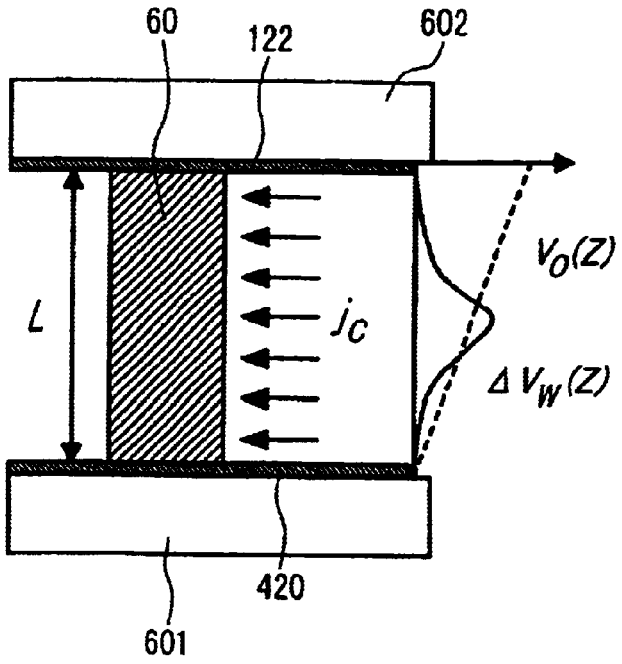
FIG.3 PRIOR ART
FIG. 3 is a sectional view schematically showing a spacer.
Figure 4:
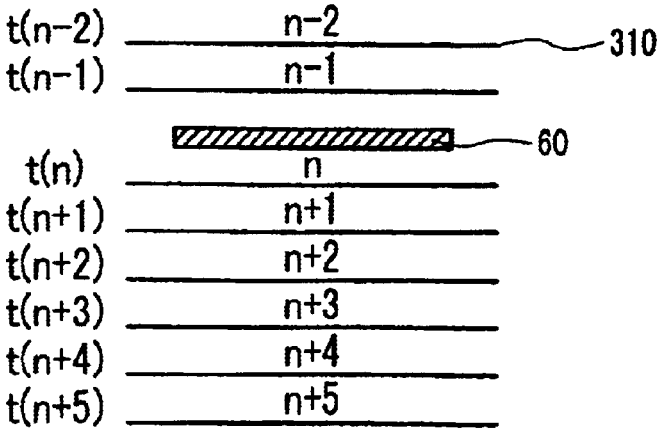
FIG.4 PRIOR ART
FIG. 4 is a diagram showing a conventional driving method of a display apparatus.
Figure 5:
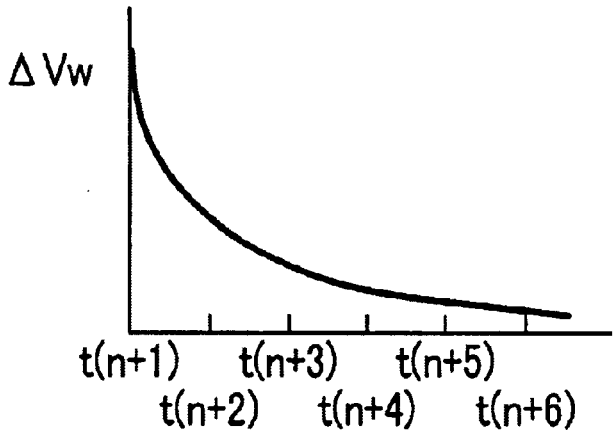
FIG. 5 is a graph showing changes with time of a degree of charging of a spacer.

In FIG. 1, the data electrodes 311 and the electron-emitter elements 301 are not shown in order to avoid complicating the drawing. In actuality, the electron-emitter elements 301 are placed on the scan electrodes 310, respectively.

Figure 14:
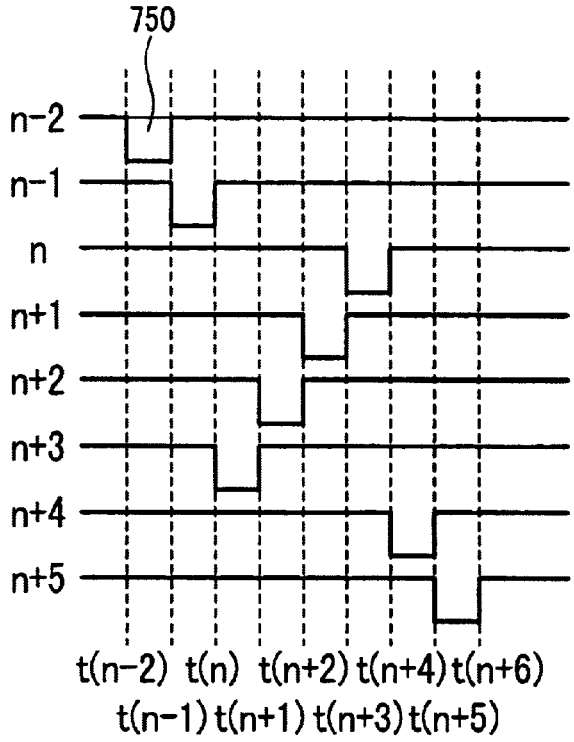
FIG. 14 is a diagram showing the driving method of the display apparatus of the first embodiment according to the present invention.

Shown in FIG. 14 are voltage waveforms indicative of timings for applying scan pulses to the scan electrodes 310, the waveforms corresponding to FIG. 1.

Referring to FIGS. 1 and 14, the scan electrode (n−2) is scanned, i.e., a scan pulse 750 is applied to the scan electrode (n−2), at the time t(n−2). Then, the scan electrode (n−1) is scanned at the time t(n−1). Thus, the scan electrodes are scanned in the order of approaching the spacer 60 from far.

Then, at the time t(n), the scan electrode (n+3) is scanned. After that, the scan electrode (n+2), the scan electrode (n+1), and the scan electrode (n) are scanned at the time t(n+1), the time t(n+2), and the time t(n+3) in this order. After that, the scan electrode (n+4) and the scan electrode (n+5) are scanned at the time t(n+4) and the time t(n+5) in this order. Thus, the scan is performed, in the vicinity of the spacer 60, in the order of approaching the spacer 60 from far.

Subsequent to scanning the scan electrode (n) which is adjacent to the spacer, a scan electrode which is remote from the spacer 60 enough not to be influenced by the spacer charging, i.e., the scan electrode (n+4), is scanned. The influence of the spacer charging is thus reduced.

Although an example of turning back from the scan electrode (n+3) is described in the present embodiment, the turning back position is not limited so far as it is not influenced by the spacer charging. The turning back position may be changed depending on parameters of a display apparatus such as a scan line pitch, material of spacer, distance between cathode plate and phosphor plate, and applied voltage to the acceleration electrode.

Figure 15:
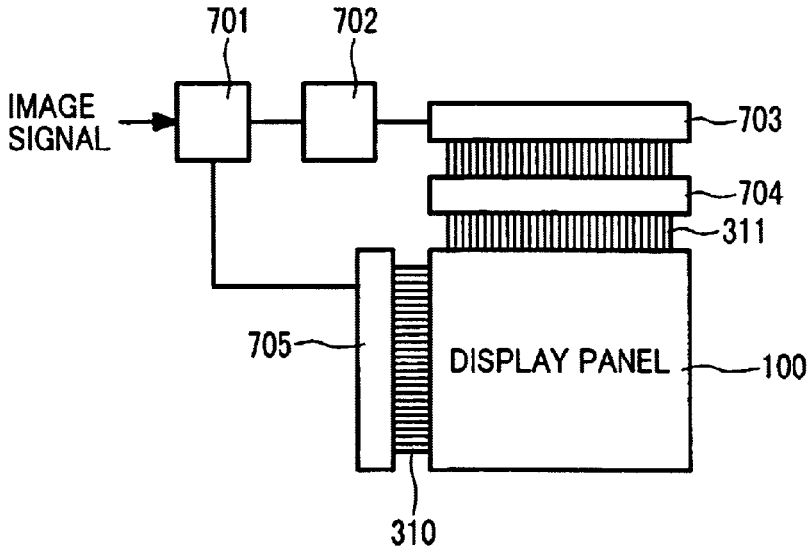
FIG. 15 is a diagram showing a configuration of driving means of the display apparatus of the first embodiment according to the present invention.

Shown in FIG. 15 is a circuit configuration for realizing the drive waveforms shown in FIGS. 1 and 14.

Image signals are inputted to a signal-processing block 701, and generation and output of timing signals, digitalization of image signals, gamma correction, and so forth are performed in the signal-processing block 701. The image signals processed by the signal-processing block 701 are inputted to a multi-line memory unit 702, and then inputted to a serial-parallel conversion block 703. A configuration and functions of the multi-line memory unit 702 will be described later in this specification. As described above, the signals to be inputted to the data electrodes are set at the circuits which correspond respectively to the data electrodes. The signals are converted into proper pulse signals by the data driver circuit 704 to be applied to the data electrodes 311 of the display panel. The serial-parallel conversion block 703 and the data driver circuit 704 may be realized as an integrated circuit.

The timing signals generated by the signal-processing block 701 are inputted to the scan driver 705 to generate the pulse waveforms shown in FIG. 14. The output signals from the scan driver 705 are applied to the scan electrodes 310 of the display panel.

Figure 16A:
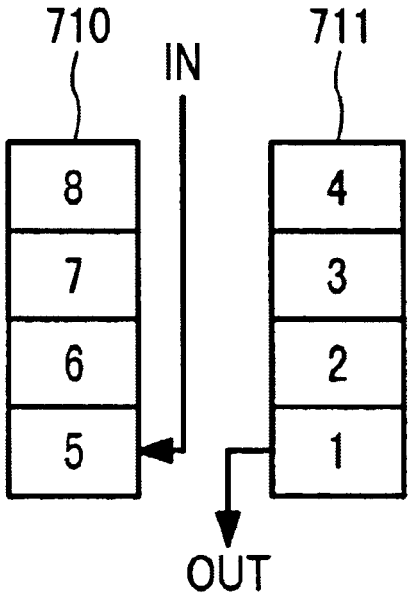
FIGS. 16A and 16B are diagrams generically showing a configuration of a multi-line memory of the driving means of the display apparatus of the first embodiment according to the present invention.
Figure 16B:
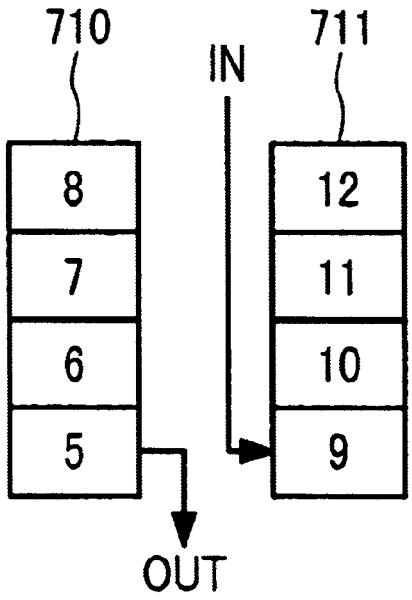

FIGS. 16A and 16B are diagrams schematically showing the configuration and functions of the multi-line memory unit 702. The multi-line memory unit 702 includes a memory block A 710 and a memory block B 711. Each of the memory blocks has a line memory for storing image signals for four lines. In FIGS. 16A and 16B, each of the numbers represents a line number of the image signals.

In FIG. 16A, when the image signals of the first line are outputted from the memory block B711, the image signals of the fifth line are inputted to the memory block A710. Then, when the image signals of the second line are outputted from the memory block B711, the image signals of the sixth line are inputted to the memory block A710. When the image signals of the fourth line are outputted, the image signals of the fifth line are outputted from the memory block A710 and, at the same time, the image signals of the ninth line are inputted to the memory block B711. By repeating this operation sequentially, the multi-line memory unit 702 operates as a time-delay memory for delaying by four lines.

Figure 17A:
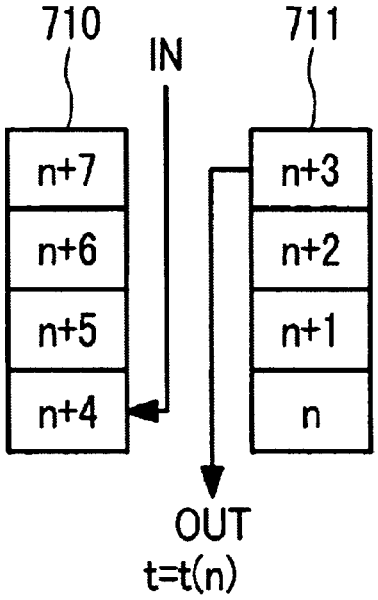
FIGS. 17A to 17C are diagrams generically showing an operation process of the multi-line memory of the driving means of the display apparatus of the first embodiment according to the present invention.
Figure 17B:
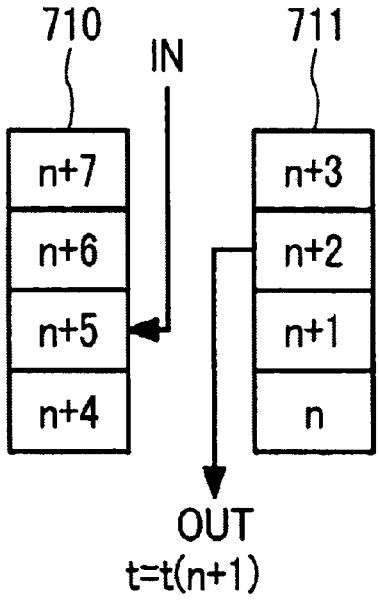
Figure 17C:
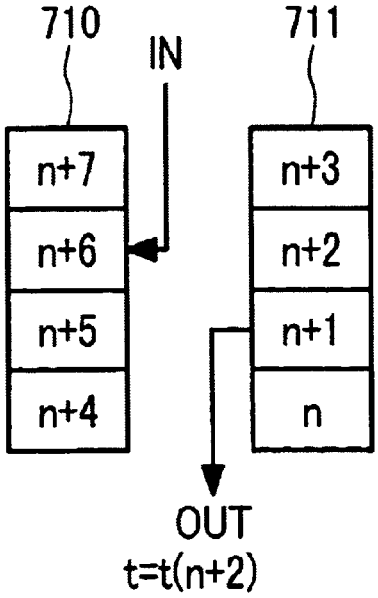

The operation at the time t(n) in FIG. 14 will be described below with reference to FIGS. 17A to 17C. As shown in FIG. 17A, signals of the (n+3)th line are outputted from the block B711 and signals of the (n+4)th line are inputted to the memory block A710 simultaneously at the time t(n). As shown in FIG. 17B, signals of the (n+2)th line are outputted from the block B711 and signals of the (n+5)th line are inputted to the memory block A710 simultaneously at the time t(n+1). As shown in FIG. 17C, signals of the (n+1)th line are outputted from the block B711 and signals of the (n+6)th line are inputted to the memory block A710 simultaneously at the time t(n+2). In the same manner, signals of the (n)th line are outputted at the time t(t+3).

As described above, the turning back of the signals to be inputted to the data electrodes (signals corresponding to image signals) is performed in accordance with the turning back of the scan signals as shown in FIG. 14. Thus, images corresponding to the original image signals are displayed on the display panel.

Alternatively, the turning-back processing shown in FIGS. 15 to 17C can be realized by using a field memory which accumulates image signals for one field. The method used in the present embodiment is superior to the method employing the field memory because it requires a remarkably small memory capacity for its realization and thus contributes to providing a low-cost display apparatus.

More specifically, according to the present embodiment, it is possible to realize a display apparatus with 400 scan lines by using a multi-line memory having a capacity for 8 lines. That is, any display device can be realized by using a multi-line memory having a capacity for not more than 1/10 of the number of scan lines.

Figure 21:
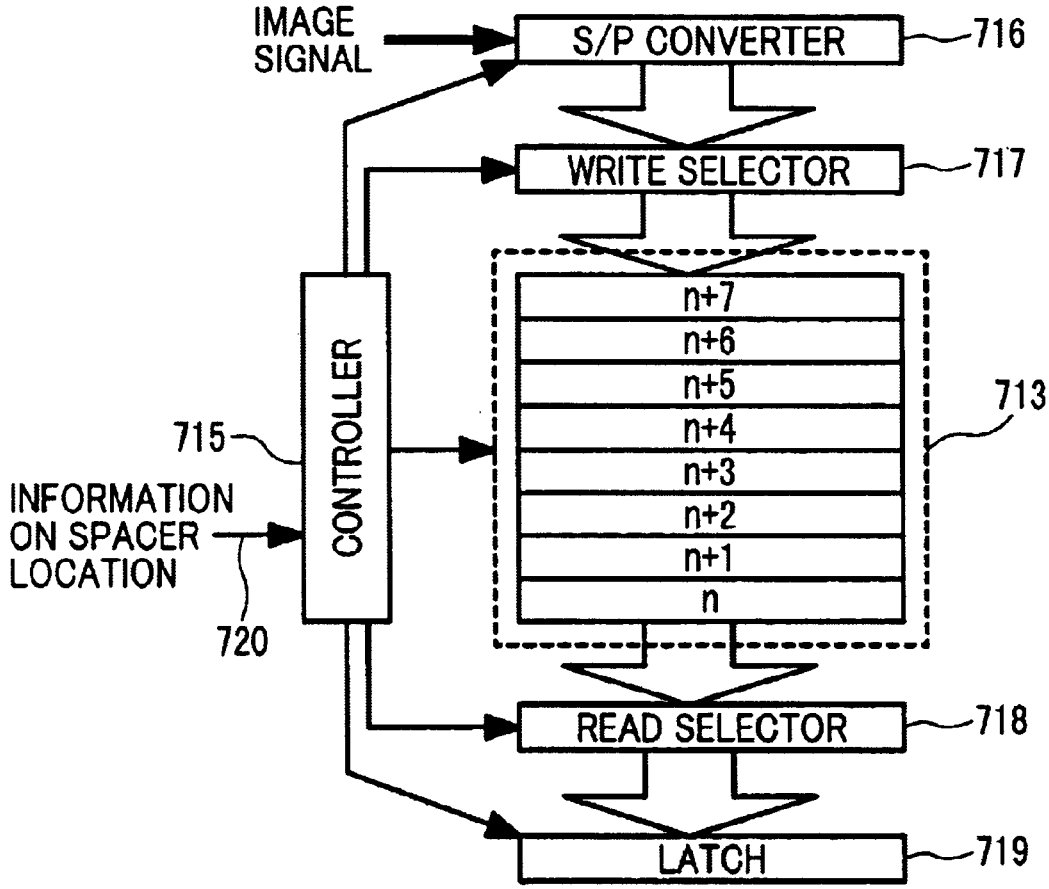
FIG. 21 is a diagram showing an example of a configuration of a multi-line memory unit of the display apparatus according to the present invention.

Shown in FIG. 21 is an example of a circuit for realizing the configuration shown in FIGS. 16A to 17C. Image signals are inputted to a serial-parallel converter 716 and then image signals for one line are converted into parallel signals. After that, the parallel signals are written on an appropriate line memory in a line memory block 713 via a write selector 717. In turn, data of an appropriate line among data which is written in the line memory block 713 is read out via a read selector 718 to be fetched to a latch circuit 719. The signals fetched to the latch circuit 719 may be inputted to driver circuits for the respective lines as they are or they may be converted into one dimensional signals again using a parallel-serial converter circuit (not shown). A controller circuit 715 controls settings for the line memory for writing, the line memory for reading, and timings for writing and reading.

As described above with reference to FIGS. 16A to 17C, the order of reading out the line memories is changed with respect to the scan lines in the vicinity of the spacer. In order to realize this operation, the controller circuit 715 receives signals of information on locations of the spacers (information on spacer location 720).

The circuit shown in FIG. 21 may be incorporated in the data driver circuit. In the incorporation, the line memory stores column data for a portion of a line, not for the whole line. For example, in the case of using a data driver IC with 256 output lines, memories for respective lines in the line memory block store image data for 256 columns. The memory storing column data of a portion of a line will also be referred to as the line memory in this specification.

Figure 22:
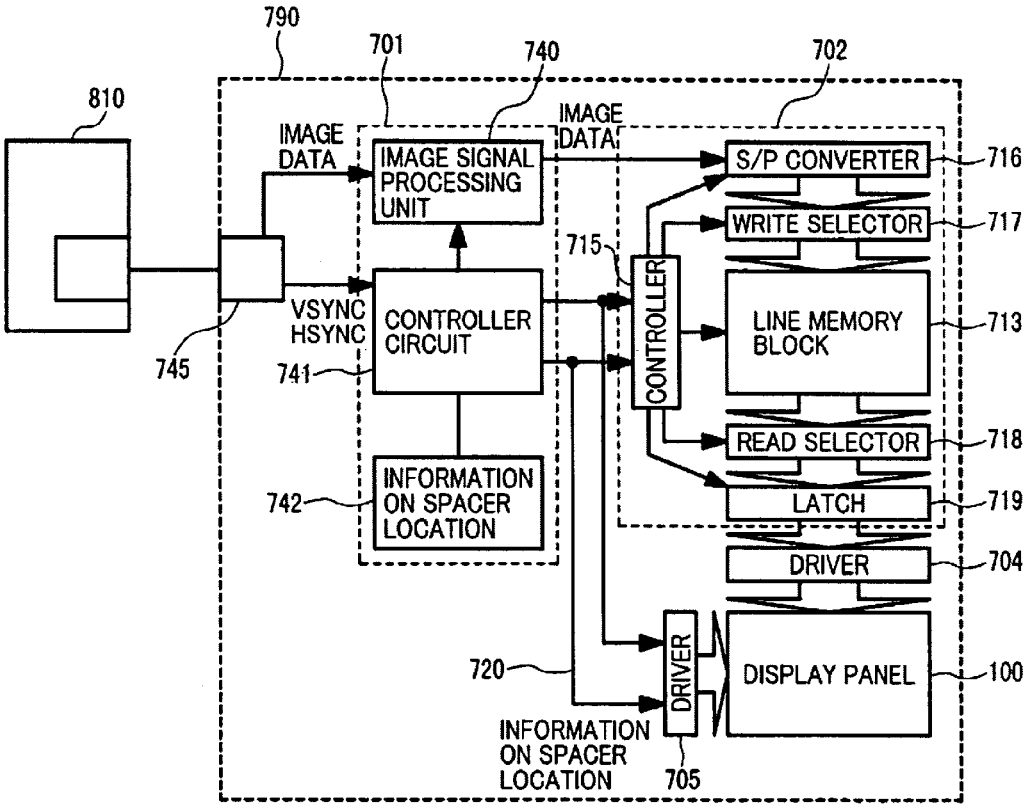
FIG. 22 is a diagram showing an example of a configuration of a display apparatus according to the present invention.

Shown in FIG. 22 is an example of a configuration of a display apparatus 790 of the first embodiment of the present invention. The display apparatus 790 has an image signal interface 745 for receiving image signals from an image signal source 810 (i.e. personal computer, video player, etc.). The image signals inputted to the image signal interface 745 are then inputted to a signal processing block 701. The signal processing block 701 has an image signal processing unit 740 and a controller circuit 741. The information on spacer location 742 is inputted to the controller circuit 741, and the controller circuit 741 properly controls the scan orders in the vicinities of the spacers by combining the information on spacer location 741 with vertical synchronizing signals and horizontal synchronizing signals which are inputted thereto from the image signal interface 745. The timing signals generated by the controller circuit 741 are inputted to the multi-line memory unit 702 and the scan driver 705.

The image signal processing unit 740 has a function of converting the image signals inputted from the image signal interface 745 into signals conformable with a brightness-signal relationship of the display panel 100 when so required, a function of digitalizing the signals when so required, and so forth. The inputted signals are outputted to the multi-line memory unit 702 after being subjected to these signal processing.

The configuration of the multi-line memory unit 702 is as described above with reference to FIG. 21.

With the above-described configurations, the image signals inputted to the image signal interface 745 are properly displayed on the display panel 100.

Embodiment 2

A second embodiment of the present invention will hereinafter be described with reference to FIG. 18.

A configuration of a display panel and a method of connecting the display panel to drive circuits are the same as those of the first embodiment.

The interlace scan method is employed in the second embodiment.

Figure 18:
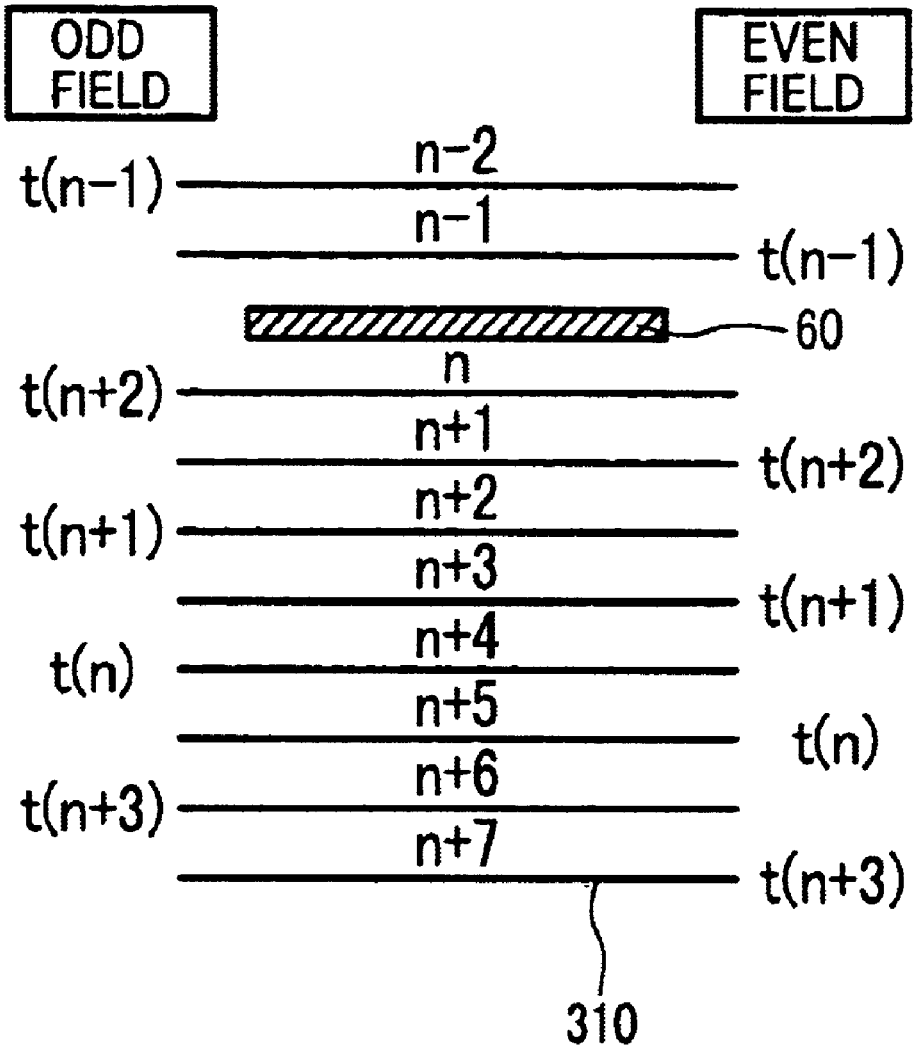
FIG. 18 is a diagram showing a driving method of a display apparatus of a second embodiment according to the present invention.

FIG. 18 corresponds to FIG. 1 of the first embodiment. More specifically, a scan order in the vicinity of a spacer 60 is shown in FIG. 18.

In the interlace scan method, scan electrodes to be scanned in an odd field are different from those to be scanned in an even field. In FIG. 18, a scan method for the odd field is shown on the left hand side, and a scan method for the even field is shown on the right hand side.

The scan until the time t(n−1) is performed in the order of approaching the spacer 60 from far.

The scan line (n+4) is scanned at the time t(n). Then, the scan line (n+2) is scanned at the time t(n+1), and the scan line (n) is scanned at the time t(n+2). Thus, in the vicinity of the spacer, the scan is performed in the order of approaching the spacer from far. The scan line (n+6) is scanned at the time t(n+3).

In the even field, the scan electrodes to be scanned are changed; however, as shown on the right hand side of FIG. 18, the scan is performed in the order of approaching the spacer.

Thus, it is possible to reduce the influence to be exerted on images due to the charging of the spacer 60.

By the use of the interlace scan method as in the second embodiment, the number of waveforms for signal processing becomes half that of a progressive scan since the number of scans of the interlace scan method is half that of the progressive scan. Therefore, the interlace scan method has the advantage of low-cost signal processing circuit.

Further, the interlace scan method is frequently used for signals for television images. Signal conversion is required for the progressive scan, and a field memory is sometimes required for performing the conversion. Accordingly, if the display panel is driven in accordance with the interlace scan method, the conversion from the interlace scan to the progressive scan is no longer necessary, thereby realizing a display apparatus wherein only the multi-line memory unit 702 shown in FIG. 15 is used as a memory. Therefore, the second embodiment contributes to simplification of the signal processing circuit and realization of low cost display apparatus.

Figure 23:
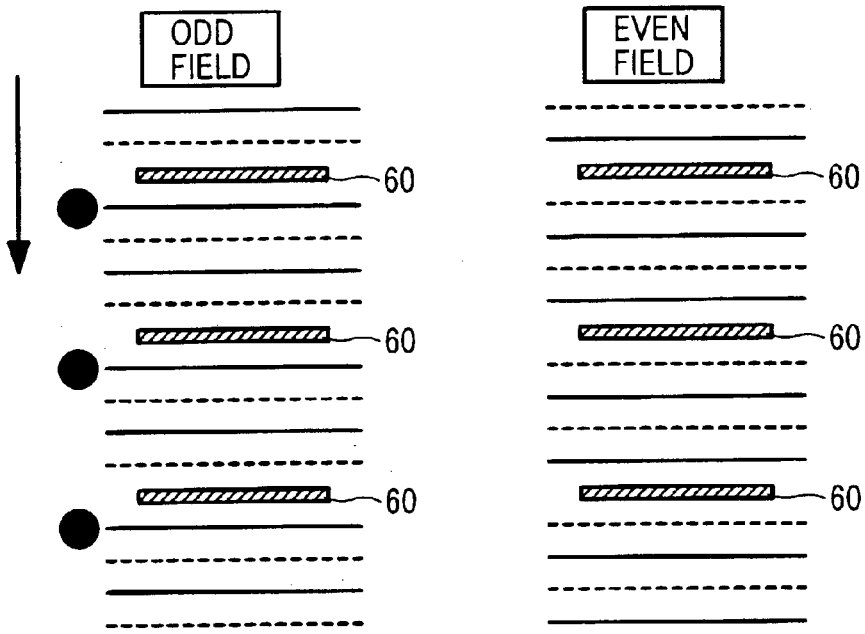
FIG. 23 is a schematic plan view showing spacers and scan lines.

It is possible to further simplify the signal processing configuration by setting the number of scan electrodes placed between spacers to an even number. This simplification method will be described below with reference to FIG. 23. Shown in FIG. 23 is an example wherein four line electrodes are placed between spacers. The continuous lines represent line electrodes to be scanned, while the dotted lines represent line electrodes which are not scanned (which do not receive scan pulses) because they are skipped in the field. The scan lines on which the problems due to the spacer charging occur when the scanning is performed in a direction indicated by an arrow are indicated by large dots. As shown in FIG. 23, the problems occur on one of two fields constituting one frame (on an odd field in FIG. 23). Accordingly, change in the scan order is unnecessary in the other field (an even field in FIG. 23) and, thus, the signal processing configuration is simplified.

In view of the above, it is preferable to set the number of spacer lines and the number of scan electrodes in such a manner as to satisfy a specific relationship therebetween. Here, "the number of spacer lines" means the number of spacers when the spacer(s) placed on a common horizontal line (along a direction parallel with the scan line) is/are counted as "one line". For example, in FIG. 24, the number of spacer lines is three although the number of spacers is six.

Figure 24:
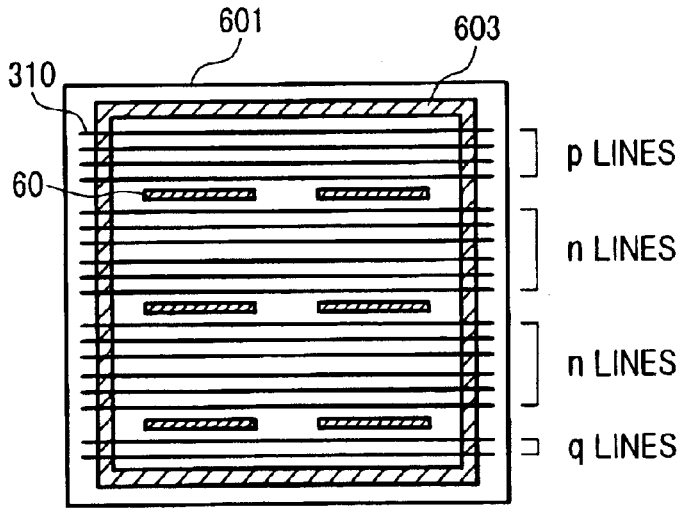
FIG. 24 is a schematic plan view showing a relationship between the number of spacers and the number of scan lines.

FIG. 24 is a plan view showing a simplified configuration of the display panel 100, wherein only scan lines (row electrodes) 310, a framing glass 603, and spacers 60 are shown. As shown in FIG. 24, n scan lines are disposed between the spacers, while p scan lines and q scan lines are respectively disposed on the outside of the spacers (between each of the spacers and the framing glass). When the number of spacer lines is m, it is preferable to set n, m, p, and q in such a manner as to satisfy a relationship of the following equation (7) with respect to the number of scan lines (line electrodes) N0:

$$N0=n\times(m-1)+p+q, \text{ wherein n is an even number} \quad (7)$$

The reason why the relationship of equation (7) is preferred is as described above with reference to FIG. 23.

Embodiment 3

A third embodiment of the present invention will hereinafter be described with reference to FIGS. 19A and 19B.

A configuration of a display panel and a method of connecting the display panel to drive circuits are the same as those of the first embodiment.

Figure 19A:
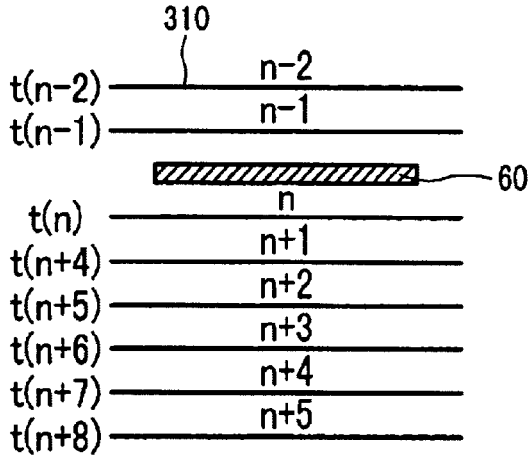
FIGS. 19A and 19B are diagrams generically showing a driving method of a display apparatus of a third embodiment according to the present invention.

FIG. 19A is a plan view corresponding to FIG. 1, wherein a portion of the spacers 60 and the scan lines 310 of the display panel 100 are schematically shown. Shown in FIG. 19B, which corresponds to FIG. 14, are timings for scanning the scan lines.

In the present embodiment, the scan line (n) which is adjacent to the spacer 60 is scanned, i.e. a scan pulse 750 is applied to the scan line (n), at the time t(n). After that, the scan line (n+1) which is second adjacent to the spacer 60 is not scanned until charging of the spacer 60 is decayed to an accepted level. The scan line (n+1) is scanned at the time t(n+4), and then the scan lines are scanned in the order of (n+2), (n+3), (n+4), and (n+5).

Waveforms of the above-described scan timings are realized by using a field memory in place of the multi-line memory unit 702 in the circuit configuration shown in FIG. 15.

Figure 19B:
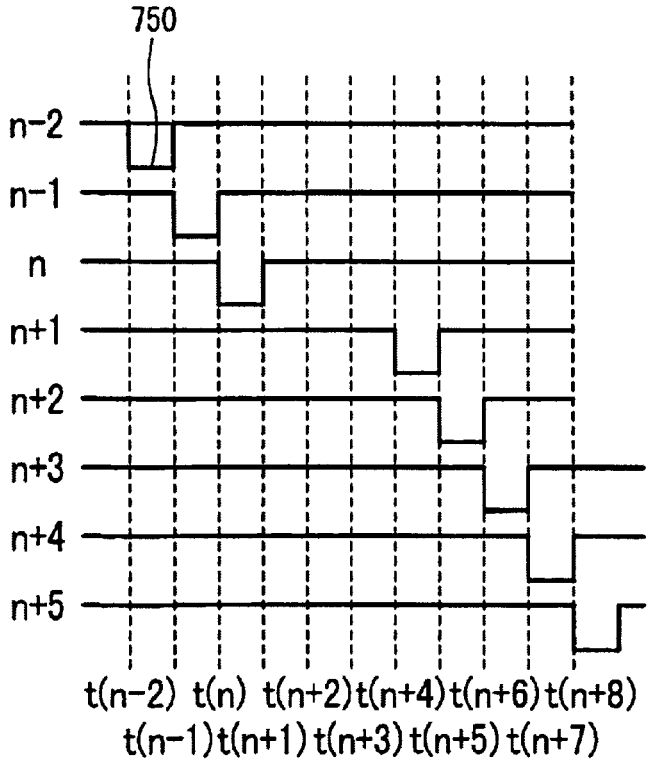

In the method of FIGS. 19A and 19B, none of the scan lines is scanned during a period from the time t(n+1) to the time t(n+4). Because of such period during which no scan line is scanned, a scan period per line, i.e. a width of scan pulse, is shortened. In other words, a duty ratio of the light emission becomes relatively small. This may be a disadvantage of the method of FIGS. 19A and 19B.

Embodiment 4

A fourth embodiment of the present invention will hereinafter be described with reference to FIGS. 20A and 20B.

A configuration of a display panel and a method of connecting the display panel to drive circuits are the same as those of the first embodiment.

Figure 20A:
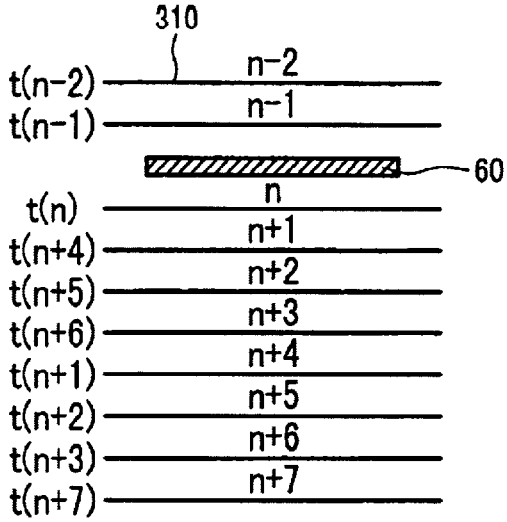
FIGS. 20A and 20B are diagrams generically showing a driving method of a display apparatus of a fourth embodiment according to the present invention.

FIG. 20A is a plan view corresponding to FIG. 1, wherein a portion of the spacers 60 and the scan lines 310 of the display panel 100 are schematically shown. Shown in FIG. 20B, which corresponds to FIG. 14, are timings for scanning the scan lines.

In the present embodiment, the scan line (n) which is adjacent to the spacer 60 is scanned, i.e. a scan pulse 750 is applied to the scan line (n), at the time t(n). Then, the scan line (n+4) is scanned at the time t(n+1). Since the scan line (n+4) is satisfactorily remote from the spacer 60, the scan line is almost free from the influence of charging of the spacer. After that, the scan lines (n+5) and (n+6) are scanned in this order. The scan line (n+1) is scanned at the time t(n+4).

In the present embodiment, after scanning the scan line (n) which is adjacent to the spacer 60, the scan line (n+1) which is second adjacent to the spacer 60 is not scanned until the spacer charging is decayed to an accepted level. Thus, the influence of the charging of the spacer 60, which is exerted on images, is reduced.

Since the scanning is performed in all the periods in the present embodiment, a duty ratio of the light emission is not reduced.

Figure 20B:
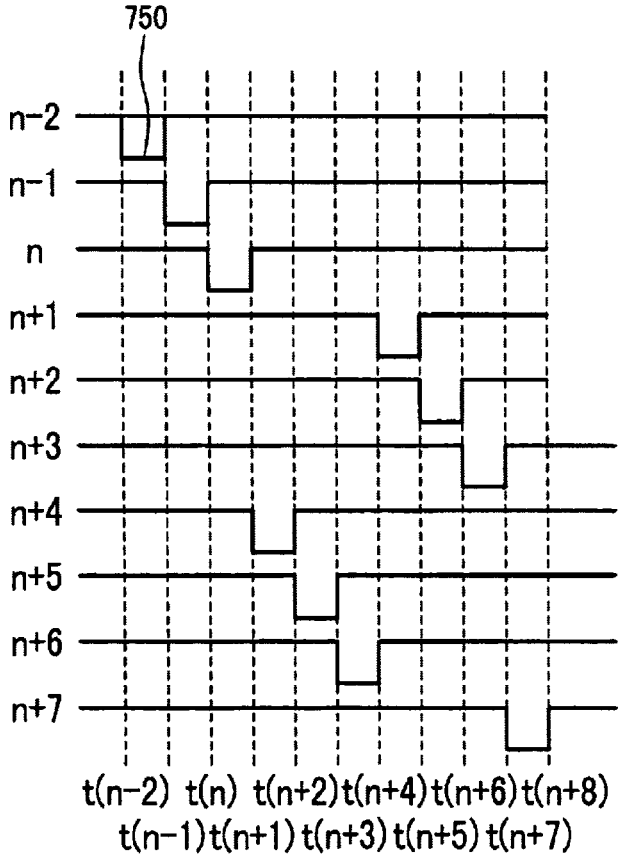

The signal waveforms of the scan timings shown in FIG. 20B are realized by using a memory having a capacity for 12 lines as the multi-line memory unit 702 in the circuit configuration of FIG. 15. More specifically, the memory of 12 lines can be used for a display apparatus having 400 scan lines. That is, the display apparatus is realized by using the multi-line memory having a capacity for 1/10 of the scan lines and, therefore, the present embodiment realizes the display apparatus at low cost like the first embodiment.

Embodiment 5

A fifth embodiment of the present invention will hereinafter be described with reference to FIGS. 25A and 25B.

A configuration of a display panel and a method of connecting the display panel to drive circuits are the same as those of the first embodiment.

Figure 25A:
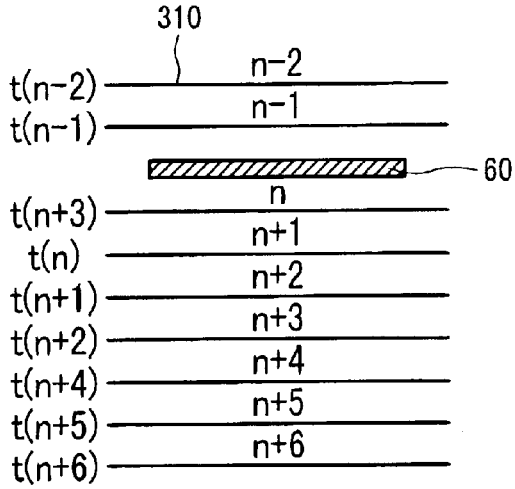
FIGS. 25A and 25B are diagrams generically showing a driving method of a display apparatus of a fifth embodiment according to the present invention.

FIG. 25A is a plan view corresponding to FIG. 1, wherein a portion of the spacers 60 and the scan lines 310 of the display panel 100 are schematically shown. Shown in FIG. 25B, which corresponds to FIG. 14, are timings for scanning the scan lines.

In the present embodiment, the scan line (n+1) is scanned after scanning the scan line (n−1) without scanning the scan line (n) which is adjacent,to the spacer 60. Then, the scan line (n+2) is scanned at the time t(n+1), and the scan line (n+3) is scanned at the time t(n+2). After that, the scan line (n) adjacent to the spacer 60 is scanned at the time t(n+3), and then the scan order returns to the ordinary one wherein the scan line (n+4) is scanned at the time t(n+4) and the scan line (n+5) is scanned at the time t(n+5).

Immediately after scanning the scan line (n) adjacent to the spacer 60 at the time t(n+3), the spacer is charged; however, the scan line (n+4) which is scanned at the time t(n+4) is so remote from the spacer that the influence of the spacer charging is not exerted thereon (remote for 5 lines in the present embodiment). Thus, the charging of the spacer 60 does not influence on images.

Figure 25B:
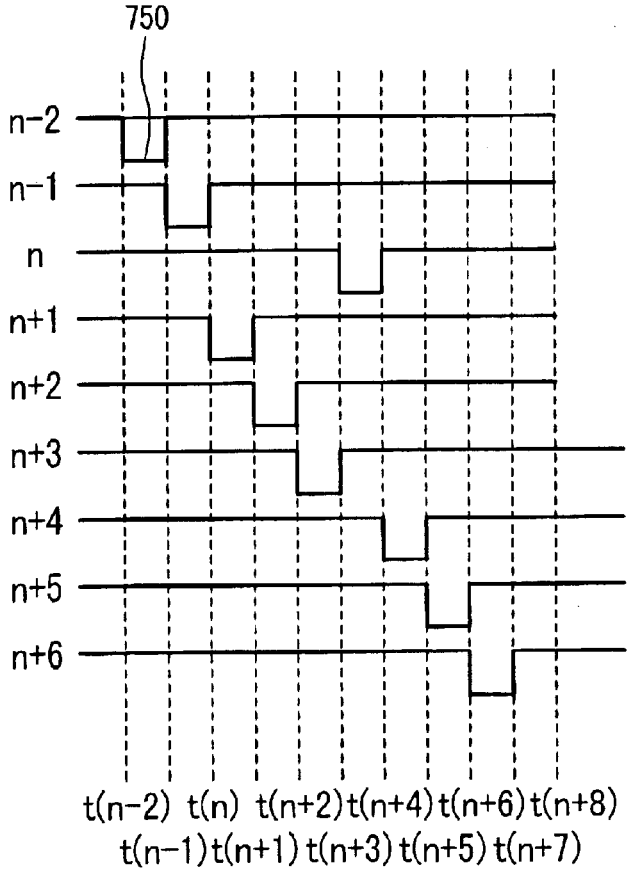
Figure 26A:
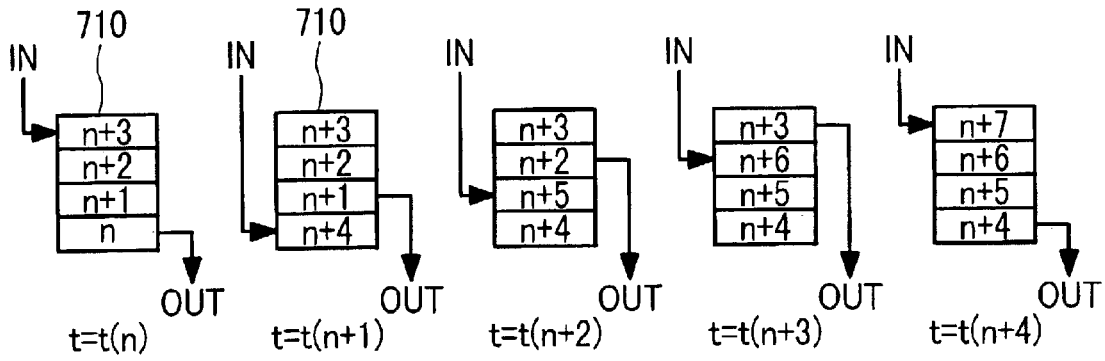
FIGS. 26A and 26B are diagrams generically showing an operation process of a multi-line memory of driving means of the display apparatus of the fifth embodiment according to the present invention.
Figure 26B:
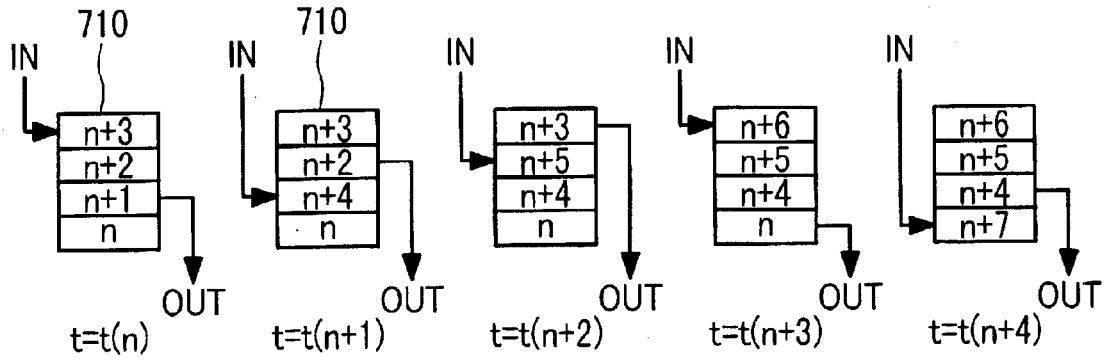

Shown in FIGS. 26A and 26B is a configuration of a multi-line memory unit 702 for realizing the scan waveforms shown in FIGS. 25A and 25B. A memory block 710 has a line memory for four lines.

Shown in FIG. 26A are inputs to and outputs from the line memory in the case of the ordinary scan order. For example, at the time t=t(n), image data of the scan line (n) are read out from the line memory, and image data of the scan line (n+3) are written on the line memory. Thus, the multi-line memory unit 702 operates as a three-line time-delay circuit in the case of the ordinary scan order.

Shown in FIG. 26B are inputs to and outputs from the line memory in the case of the scan order in the vicinity of the spacer. The scan line (n) in FIG. 26B corresponds to that of FIGS. 25A and 25B. For example, at the time t=t(n), image data of the scan line (n+3) are written on the line memory, and image data of the scan line (n+1) are read out. At the time t=t(n+1), image data of the scan line (n+4) are written on the line memory, and image data of the scan line (n+2) are read out. At the time t=t(n+3) image data of the scan line (n) are read out. Thus, it is possible to read out the image data in accordance with the scan order shown in FIGS. 25A and 25B.

Since the embodiment of FIGS. 25A and 25B can be realized by using the line memory for four lines, the embodiment is realized at low cost.

The example of using the thin-film electron emitters as the electron emitter-elements 301 is described in the present specification; however, the present invention is not limited to the use of thin-film electron emitters and applicable to all types of flat display apparatuses so far as they have electron-emitter elements and spacers. Examples of the electron-emitter element include a field-emission type electron emitter, a surface-conduction electron emitter, a carbon-nanotube electron emitter, and a ballistic electron surface-emitting cathode. The surface-conduction electron emitter is disclosed in, for example, Journal of the Society for Information Display, vol. 5, No. 4 (1997), pp. 345–348. The ballistic electron surface-emitting cathode is disclosed in, for example, 2001 SID International Symposium Digest of Technical Papers, pp. 188–191 (2001, California).

According to the present invention, excellent images are obtained by largely reducing or eliminating image distortion which is caused by the spacer charging.

The reference characters will be described to facilitate understanding of the drawings.

11: top electrode, 12: insulator, 13: base electrode, 14: substrate, 32: top electrode busline, 41: scan drive circuit, 42: data drive circuit, 43: acceleration electrode drive circuit, 60: spacer, 100: display panel, 110: front panel, 114: phosphor, 120: black matrix, 122: acceleration electrode, 301: electron-emitter element, 310: scan electrode, 311: data electrode, 601: cathode plate, 602: phosphor plate, 603: frame component, 701: signal processing block, 702: multi-line memory unit, 703: serial-parallel conversion block, 704: data driver circuit, 705: scan driver, 710: memory block A, 711: memory block B, 720: information on spacer location, 750: scan pulse, 751: data pulse, and 754: reverse pulse.

What is claimed is:

1. A display apparatus comprising:

a display panel, the display panel including a first substrate having a plurality of electron-emitter elements, a second substrate having phosphors, and spacers; and driving means employing a line-sequential scanning operation;

wherein scan pulse output is performed by the driving means, and the driving means performs scanning in the vicinity of the spacers in such a manner that the driving means scans in an order that approaches each of the spacers from both sides of the spacers.

2. The display apparatus according to claim 1, wherein the driving means has multi-line memory means for storing image signals for a plurality of lines.

3. The display apparatus according to claim 2, wherein the multi-line memory means has a memory capacity for scan lines of not more than 1/10 of actual scan lines.

4. The display apparatus according to claim 1, wherein interlace scanning is performed.

5. A display apparatus according to claim 4, wherein a number of scan lines placed between adjacent spacers is an even number.

6. A display apparatus comprising:

a display panel, the display panel including a first substrate having a plurality of electron-emitter elements, a second substrate having phosphors, and spacers; and driving means employing a line-sequential scanning operation;

wherein scan pulse output is performed by the driving means, and the driving means performs scanning in such a manner that scan lines other than those adjacent to and second adjacent to a relevant one of the spacers are scanned during a period from after an application of a scan pulse to the adjacent scan line to an application of a scan pulse to the second adjacent scan line.

7. The display apparatus according to claim 6, wherein the driving means has multi-line memory means for storing image signals for a plurality of lines.

8. The display apparatus according to claim 6, wherein interlace scanning is performed.

9. The display apparatus according to claim 7, wherein the multi-line memory means has a memory capacity for scan lines of not more than 1/10 of actual scan lines.

10. A display apparatus according to claim 8, wherein a number of scan lines placed between adjacent spacers is an even number.

11. A display apparatus comprising:

a display panel, the display panel including a first substrate having a plurality of electron-emitter elements, a second substrate having phosphors, and spacers; and driving means employing a line-sequential scanning operation;

wherein the display panel further includes scan lines; the scan lines include an adjacent scan line which is adjacent to a relevant one of the spacers and a nearby scan-lines region consisting of a plurality of scan lines which include a scan line adjacent to the adjacent scan line; scan pulse output is performed by the driving means; and the driving means applies a scan pulse to the adjacent scan line after applying scan pulses to the scan lines in the nearby scan-lines region.

12. The display apparatus according to claim 11, wherein interlace scanning is performed.

13. The display apparatus according to claim 11, wherein the driving means has multi-line memory means for storing image signals for a plurality of lines.

14. The display apparatus according to claim 13, wherein the multi-line memory means has a memory capacity for scan lines of not more than 1/10 of actual scan lines.

15. A display apparatus according to claim 12, wherein a number of scan lines placed between adjacent spacers is an even number.

16. A display apparatus comprising:

a display panel, the display panel including a first substrate having a plurality of electron-emitter elements, a second substrate having phosphors, and spacers; and driving means employing a line-sequential scanning operation;

wherein, when a number of scan lines placed between an adjacent pair of the spacers is represented by n, the numbers of scan lines placed at the outsides of the adjacent spacers are respectively represented by p and q, and a number of spacer lines is represented by m, an equation of number of scan lines=$n \times m-1+p+q$, wherein n is an even number, is satisfied.

17. A display apparatus comprising:

a display panel, the display panel including a first substrate having a plurality of electron-emitter elements, a second substrate having phosphors, and spacers; and driving means employing a line-sequential scanning operation;

wherein the driving means has memory means for storing information on spacer location.

18. A display apparatus comprising:

a display panel, the display panel including a first substrate having a plurality of electron-emitter elements, a second substrate having phosphors, and spacers; and driving means employing a line-sequential scanning operation;

wherein scan pulse output is performed by the driving means, and scanning is suspended during a period from after an application of a scan pulse to a scan line which is adjacent to a relevant one of the spacers to an application of a scan pulse to a scan line which is second adjacent to the spacer.

* * * * *